US009713350B1

(12) United States Patent
Colburn

(10) Patent No.: US 9,713,350 B1
(45) Date of Patent: Jul. 25, 2017

(54) BRASSIERE WITH REMOVABLE INSERTS

(71) Applicant: Sara T. Colburn, Longmeadow, MA (US)

(72) Inventor: Sara T. Colburn, Longmeadow, MA (US)

( * ) Notice: Subject to any disclaimer, the term of this patent is extended or adjusted under 35 U.S.C. 154(b) by 0 days.

(21) Appl. No.: 15/069,066

(22) Filed: Mar. 14, 2016

(51) Int. Cl.
*A41C 3/06* (2006.01)
*A41C 3/00* (2006.01)
*A41C 3/02* (2006.01)

(52) U.S. Cl.
CPC ..... *A41C 3/065* (2013.01); *A41C 3/0078* (2013.01); *A41C 3/02* (2013.01)

(58) Field of Classification Search
CPC ..... A41C 3/148; A41C 3/0065; A41C 3/0078; A41C 3/00; A41C 3/10; A41C 3/12; A41C 3/144; A41C 3/146
USPC ..... 450/81, 88, 54–57, 38, 36
See application file for complete search history.

(56) References Cited

U.S. PATENT DOCUMENTS 3,221,748 A * 12/1965 Glasser ..... A41C 3/10 450/56
4,166,471 A * 9/1979 Griffin ..... A41C 3/148 450/54
6,257,951 B1 * 7/2001 DeMarco ..... A41C 3/0078 450/41
7,407,429 B2 * 8/2008 Chen ..... A41C 3/08 450/54
8,029,332 B2 * 10/2011 Nadsady ..... A41C 3/065 450/38
2003/0129923 A1 * 7/2003 Chong ..... A41C 3/065 450/81
2003/0224700 A1 * 12/2003 Chen ..... A41C 3/065 450/88
2004/0023594 A1 * 2/2004 Chen ..... A41C 3/065 450/81
2005/0079796 A1 * 4/2005 Chou ..... A41C 3/065 450/81
2006/0166602 A1 * 7/2006 Cho ..... A41C 3/065 450/81
2009/0130952 A1 * 5/2009 Chen ..... A41C 3/146 450/38
2009/0298386 A1 * 12/2009 Deal ..... A41C 3/065 450/81

* cited by examiner

*Primary Examiner* — Gloria Hale
(74) *Attorney, Agent, or Firm* — Cantor Colburn LLP

(57) ABSTRACT

A removable insert for use with a brassiere includes a body having a first surface and a second surface opposite the first surface. At least a portion of the second surface is configured to provide removable attachment to a user's skin. A mechanical connection associated with the body is configured to provide removable attachment of the body to the brassiere. The first surface is disposed adjacent the brassiere when the body is attached to the brassiere.

30 Claims, 7 Drawing Sheets

BRASSIERE WITH REMOVABLE INSERTS

BACKGROUND

The present disclosure relates to a backless, strapless brassiere, and more particularly, to a removable insert having a surface including a pressure sensitive adhesive layer for adjoining the inserts to the user.

Brassieres ("bras") are generally undergarments which a wearer wants to conceal, and which are worn to contour and support a user's breasts. A backless, strapless bra is an undergarment known in the art and is typically worn under clothing when a bra with shoulder straps or a traditional strapless bra would be visible and detract from the appearance of the clothing. Generally, backless, strapless bras include two cups and a connecting material. These garments provide contouring and a smooth appearance or silhouette to the breasts under clothing, and may also contain padding to further enhance the appearance and shape of the breasts.

Backless, strapless bras secured in place to the breast area by adhesive substances to support and cover the breasts are known in the art. In addition to the limited support they provide, the adhesive of a strapless, adhesive bras tends to lose its effectiveness upon exposure to moisture, humidity, and turbidity, such as while being worn for example. Accordingly, with each wearing, the strength of the adhesive which holds the undergarment in place is substantially reduced, thereby limiting the overall length of wearable time and the number of total uses of the bra. Consequently, strapless adhesive bras have a reduced lifespan, making them disposable.

SUMMARY

According to one embodiment, a removable insert for use with a brassiere includes a body having a first surface and a second surface opposite the first surface. At least a portion of the second surface is configured to provide removable attachment to a user's skin. A mechanical connection associated with the body is configured to provide removable attachment of the body to the brassiere. The first surface is disposed adjacent the brassiere when the body is attached to the brassiere.

In addition to one or more of the features described above, or as an alternative, further embodiments the at least a portion of the second surface configured to provide removable attachment to a user's skin comprises a pressure sensitive adhesive layer disposed at the second surface.

in addition to one or more of the features described above, or as an alternative, further embodiments a removable covering is disposed over the pressure sensitive adhesive layer.

In addition to one or more of the features described above, or as an alternative, further embodiments the at least a portion of the second surface configured to provide removable attachment to a user's skin comprises:

In addition to one or more of the features described above, or as an alternative, further embodiments at least a portion of the second surface composed of a resilient sticky polymer material.

In addition to one or more of the features described above, or as an alternative, further embodiments the brassiere includes at least one cup and wherein the mechanical connection is configured to provide removable attachment of the body to an interior surface of the at least one cup.

In addition to one or more of the features described above, or as an alternative, further embodiments the body has a shape that is complementary to the at least one cup.

In addition to one or more of the features described above, or as an alternative, further embodiments the mechanical connection comprises at least one of a snap fit connection, press fit connection, and loose fit connection.

In addition to one or more of the features described above, or as an alternative, further embodiments the mechanical connection further comprises at least one of a male connector and a female connector disposed at the body for connection to a cooperating male or female connector disposed at the brassiere. Mating of the connectors attaches the body to the brassiere.

In addition to one or more of the features described above, or as an alternative, further embodiments the mechanical connection further comprises at least one of (a) a plurality of hooks and (b) a plurality of loops disposed at the body for connection to cooperating hooks or loops disposed at the brassiere. Engagement of the hooks and loops attaches the body to the brassiere.

In addition to one or more of the features described above, or as an alternative, further embodiments when the mechanical connection does not extend beyond the second surface.

According to another embodiment, a brassiere includes a pair of cups. Each of the cups has an exterior surface and an interior surface arranged opposite the exterior surface. A connector couples the pair of cups together in a side-by-side relationship. At least one removable insert includes a body having a first surface and a second surface opposite the first surface. At least a portion of the second surface is configured to provide removable attachment to a user's skin. A mechanical connection associated with at least one of the cups and the body is configured to provide removable attachment of the body to at least one of the cups. The first surface is disposed adjacent the interior surface of the at least one cup when the body is attached to the at least one cup.

In addition to one or more of the features described above, or as an alternative, further embodiments the at least one removable insert comprises a pair of removable inserts, further wherein the body of each of the pair of inserts is connected to a corresponding one of the cups.

In addition to one or more of the features described above, or as an alternative, further embodiments the connector coupling the pair of cups selectively couples the cups.

In addition to one or more of the features described above, or as an alternative, further embodiments the connector coupling the pair of cups fixedly couples the cups.

In addition to one or more of the features described above, or as an alternative, further embodiments the brassiere is a backless and strapless brassiere.

In addition to one or more of the features described above, or as an alternative, further embodiments the at least a portion of the second surface configured to provide removable attachment to a user's skin comprises a pressure sensitive adhesive layer disposed at the second surface.

in addition to one or more of the features described above, or as an alternative, further embodiments a removable covering is disposed over the pressure sensitive adhesive layer.

In addition to one or more of the features described above, or as an alternative, further embodiments the at least a portion of the second surface configured to provide removable attachment to a user's skin comprises at least a portion of the second surface composed of a resilient sticky polymer material.

In addition to one or more of the features described above, or as an alternative, further embodiments the mechanical connection is configured to provide removable attachment of the body to the interior surface of the at least one cup.

In addition to one or more of the features described above, or as an alternative, further embodiments the body has a shape that is complementary to at least one of the cups.

In addition to one or more of the features described above, or as an alternative, further embodiments the mechanical connection comprises at least one of a snap fit connection, press fit connection, and loose fit connection.

In addition to one or more of the features described above, or as an alternative, further embodiments the mechanical connection further comprises a male connector and a female connector that mates with the male connector. One of the male connector and the female connector is disposed at the body and the other of the one of the male connector and the female connector is disposed at the at least one of the cups. Mating of the male connector and the female connector attaches the body to the at least one of the cups.

In addition to one or more of the features described above, or as an alternative, further embodiments the mechanical connection further comprises a plurality of hooks and a plurality of loops that engage with the plurality of hooks. One of the plurality of hooks and the plurality of loops is disposed at the body and the other of the one of the plurality of hooks and the plurality of loops is disposed at the at least one of the cups. Engagement of the plurality of hooks and the plurality of loops attaches the body to the at least one of the cups.

In addition to one or more of the features described above, or as an alternative, further embodiments when the mechanical connection does not extend beyond the second surface.

A backless and strapless brassiere receptive to at least one removable insert includes a pair of cups. Each of the pair of cups has an exterior surface and an interior surface arranged opposite the exterior surface. A connector couples the pair of cups together in a side-by-side relationship. A mechanical connection associated with at least one of the pair of cups is configured to provide removable attachment of at least one of the cups to at least one removable insert. The at least one removable insert is disposed adjacent the interior surface of the at least one cup when the at least one removable insert is attached to the at least one cup.

In addition to one or more of the features described above, or as an alternative, further embodiments the connector coupling the cups selectively couples the cups.

In addition to one or more of the features described above, or as an alternative, further embodiments the connector coupling the cups fixedly couples the cups.

In addition to one or more of the features described above, or as an alternative, further embodiments the mechanical connection comprises at least one of a snap fit connection, press fit connection, and loose fit connection.

In addition to one or more of the features described above, or as an alternative, further embodiments the mechanical connection further comprises at least one of a male connector and a female connector disposed at the at least one of the cups for connection to a cooperating male or female connector disposed at the at least one removable insert. Mating of the connectors attaches the at least one of the cups to the at least one removable insert.

In addition to one or more of the features described above, or as an alternative, further embodiments wherein the mechanical connection further comprises at least one of (a) a plurality of hooks and (b) a plurality of loops disposed at the at least one of the cups for connection to cooperating hooks or loops disposed at the at least one removable insert. Engagement of the hooks and loops attaches the at least one of the cups to the at least one removable insert.

BRIEF DESCRIPTION OF THE FIGURES

The accompanying drawings incorporated in and forming a part of the specification embodies several aspects of the present invention and, together with the description, serves to explain the principles of the invention. In the drawings.

The detailed description explains embodiments of the invention, together with advantages and features, by way of example with reference to the drawings.

DETAILED DESCRIPTION

Figure 1:
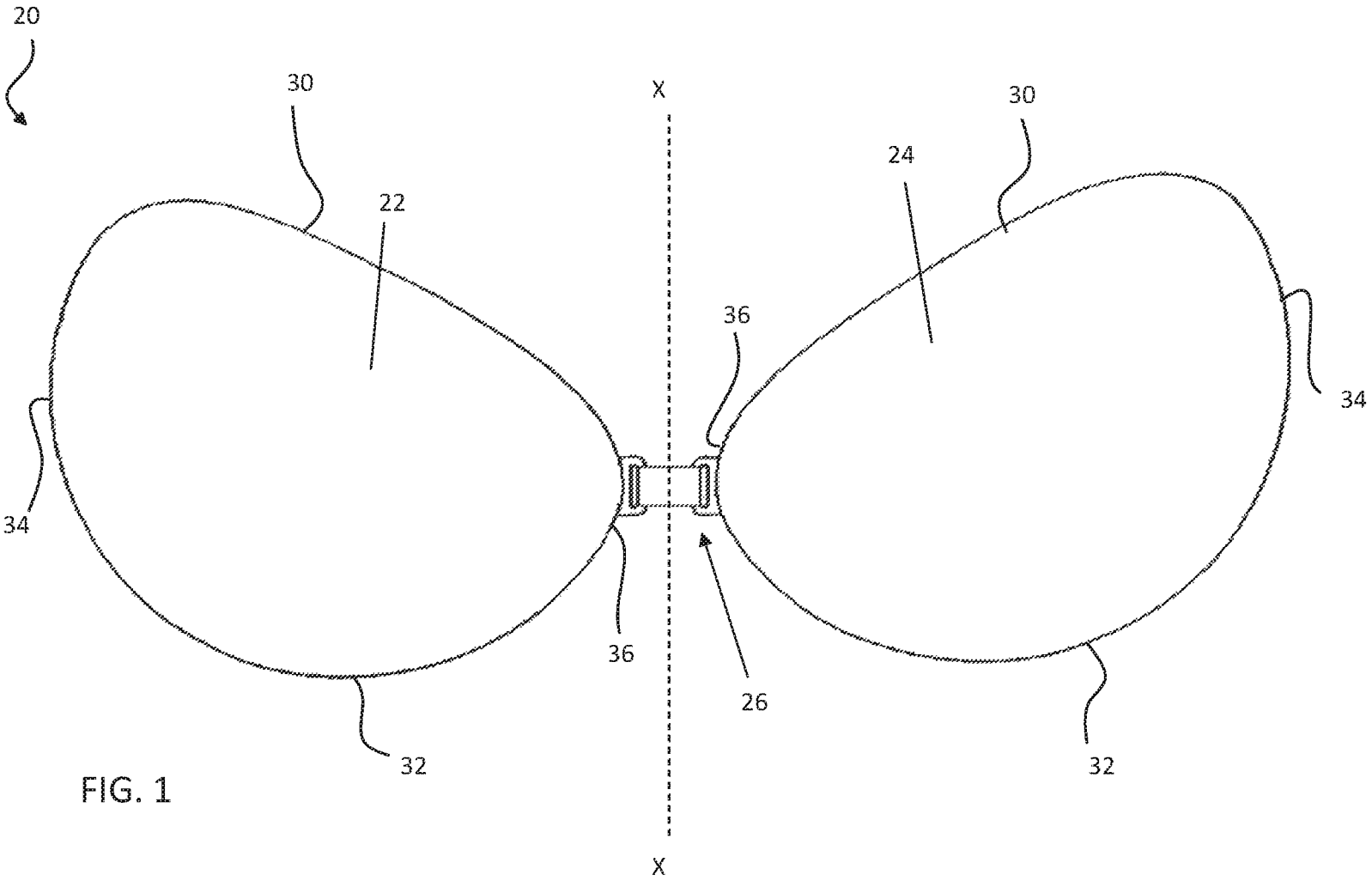
FIG. 1 is a front view of an example of a backless, strapless bra.

Referring now to the FIG. 1, an example of a backless, strapless bra 20 is illustrated. As shown, the bra 20 includes a first cup 22 and a second cup 24 adjoined by a connector 26. In the illustrated, non-limiting embodiment, the connector 26 extends between opposing surfaces of the two cups 22, 24 and is operable to selectively couple and decouple the first and second cups 22, 24. In such embodiments, the first cup 22 and the second cup 24 are separate articles that may be positioned on the left and right breast of a user independently. In other embodiments, the connector 26 may be integrally formed with and fixedly couple the first and second cups 22, 24. The first cup 22 and the second cup 24 may be formed from any of a plurality of suitable materials, including, but not limited to a soft woven material, a knitted fabric, and a plastic, such as silicone for example.

Figure 2:
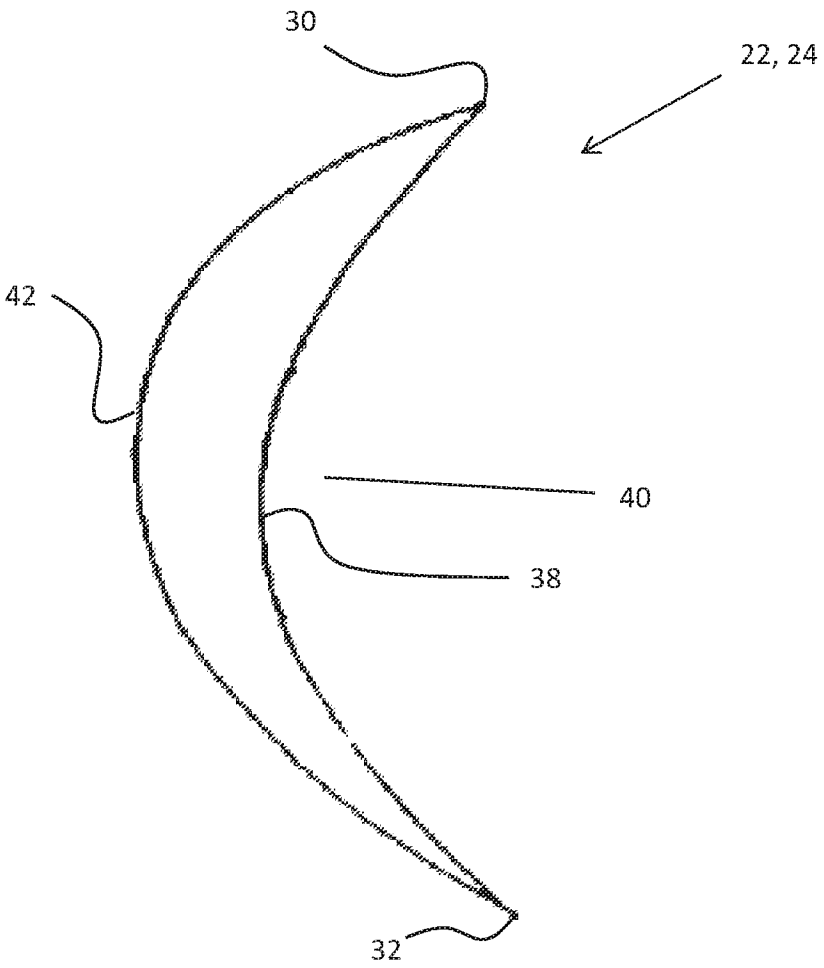
FIG. 2 is a cross-sectional view of a portion of the backless, strapless bra of FIG. 1.

The first cup 22 and the second cup 24 of the bra 20 are similar in shape and are generally symmetrical about a central plane X disposed there between. Each cup 22, 24 of the bra 20 has a respective top 30, bottom 32, outer edge 34, and an inner edge 36. Embodiments where an underwire and/or additional padding (not shown) is arranged within each cup 22, 24, such as adjacent the bottom 32 thereof for example, are considered within the scope of the disclosure. Referring now to FIG. 2, each cup 22, 24 additionally includes a concave interior surface 38 configured to define a cavity 40 within which at least a portion of a user's breast is received, and an exterior surface 42, facing away from the user's breast.

Figure 3:
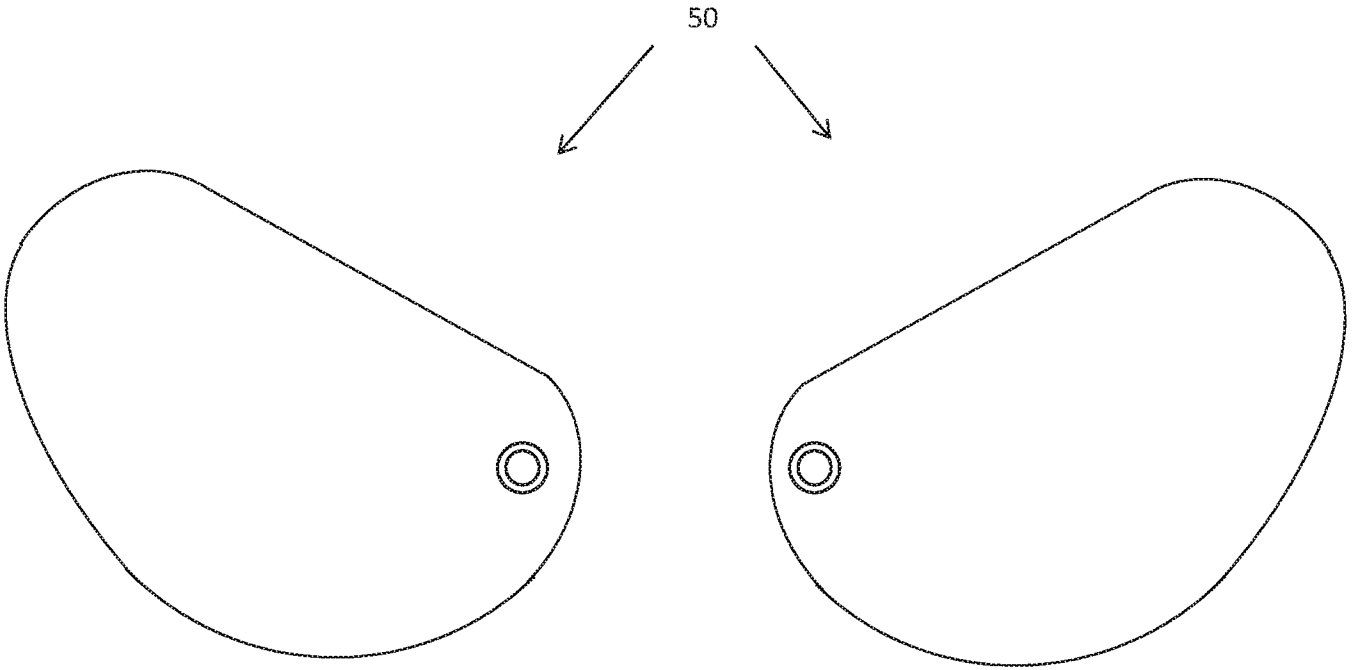
FIG. 3 is a front view of a pair of inserts configured for use with the first and second cup according to an embodiment.
Figure 4:
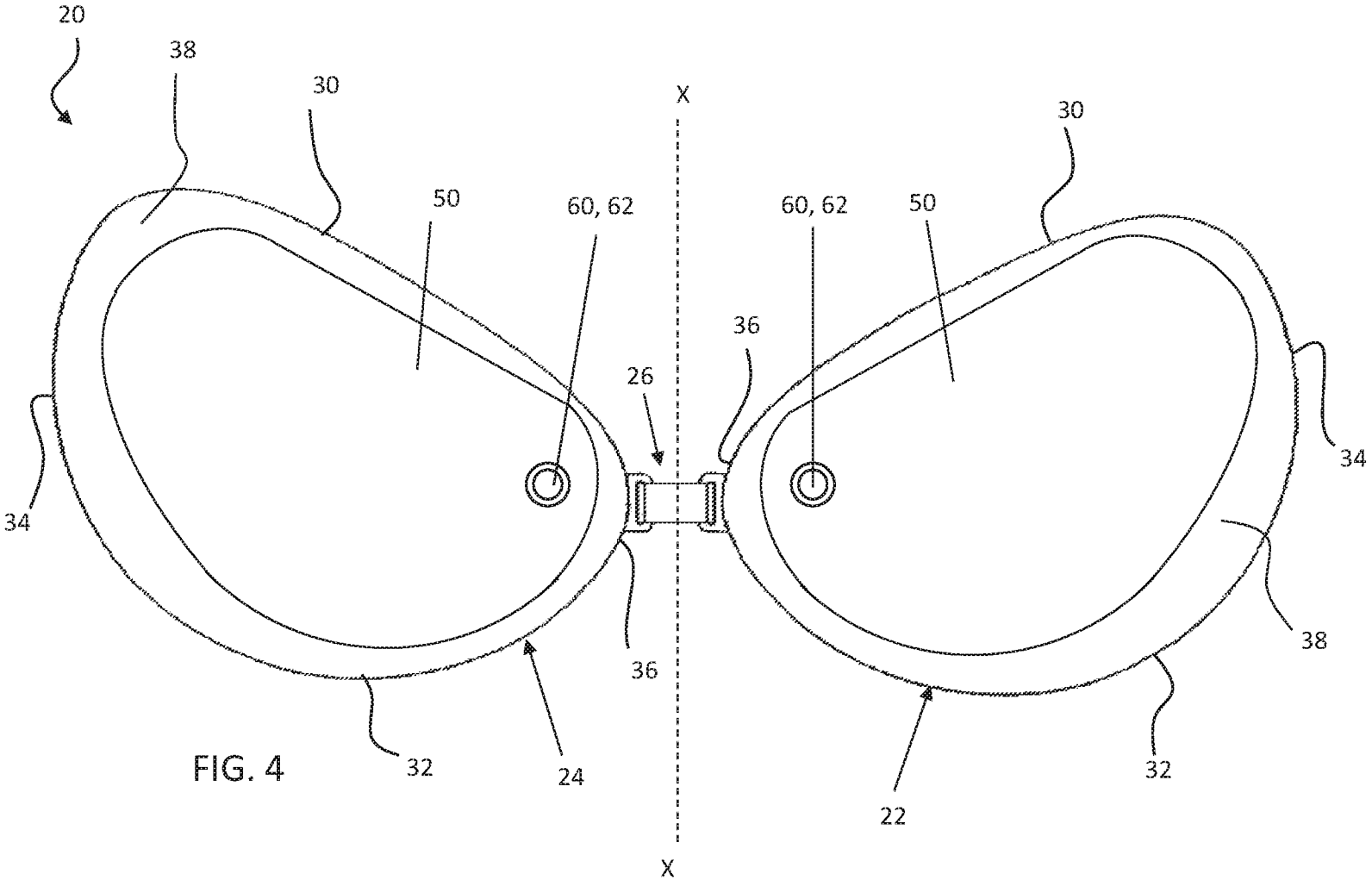
FIG. 4 is a front view of the backless strapless bra having inserts coupled to the interior surface of the first and second cup according to an embodiment.

Referring now to FIG. 3, to prolong the usable life of a backless, strapless bra 20, an insert 50 may be positioned within each cavity 40 formed by the interior surface 38 of each cup 22, 24. However, it should be understood that the inserts 50 illustrated and described herein may be configured for use with any type of bra, including those that do not include a pressure sensitive adhesive layer. With reference now to FIGS. 4.6, examples of some embodiments of the inserts 50 configured for use with the bra 20 are illustrated in more detail.

Figure 6:
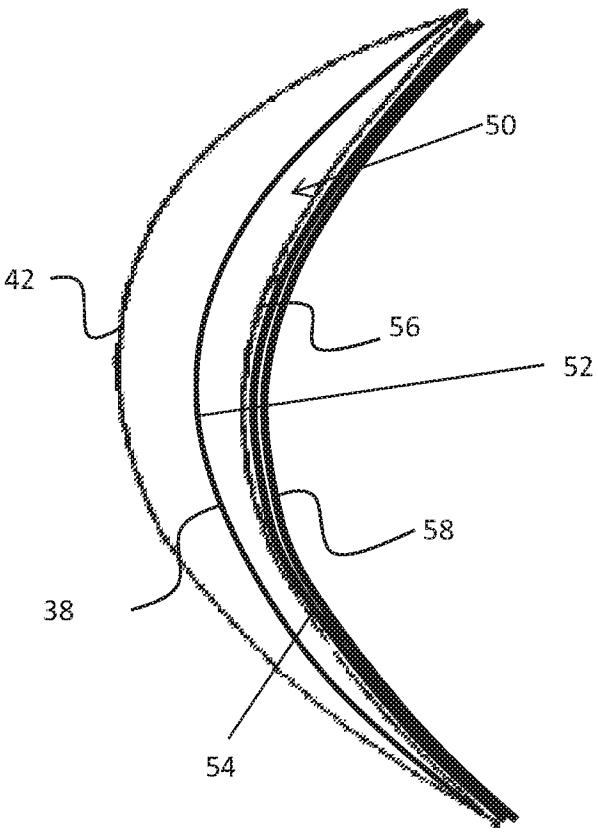
FIG. 6 is a cross-sectional view of a portion of the backless, strapless bra of FIG. 4 according to an embodiment.

The inserts 50 may be formed from any of a plurality of suitable materials, including, but not limited to a soft woven material, a knitted fabric, and a plastic, such as silicone for example. As best shown in FIG. 6, each insert 50 includes a body having a first surface 52 configured to contact and couple to the interior surface 38 of a respective cup 22, 24, and a second, opposite surface 54 facing a user. At least a portion of the surface 54 includes a pressure sensitive adhesive layer 56 configured to adhere to a user's skin when arranged in contact therewith. The pressure sensitive adhesive layer 56 may be formed including any adhesive material suitable for use with skin and, optionally, having sufficient adhesion strength to be attached and removed from a user's skin a plurality of times. A removable protective coating 58 (see FIG. 6) may be provided in overlapping arrangement with the pressure sensitive adhesive layer 56 prior to use of the insert 50 to prevent debris and other particles from contaminating and reducing the effectiveness of the adhesive layer 56. Alternatively, at least a portion of the surface 54 (or the entire insert 50) may be formed from a polymer material including a tackifier to provide a clinging characteristic, similar to an adhesive. Such a resilient sticky polymer material may comprise for example a polymerizing styrene, butadiene, napthenic oil, calcium carbonate and hydrogenated polyterpene resin, with the latter being the tackifier. What is important, is that at least a portion of the surface 54 (or the entire insert 50) is configured to provide removable attachment to a user's skin.

Figure 5:
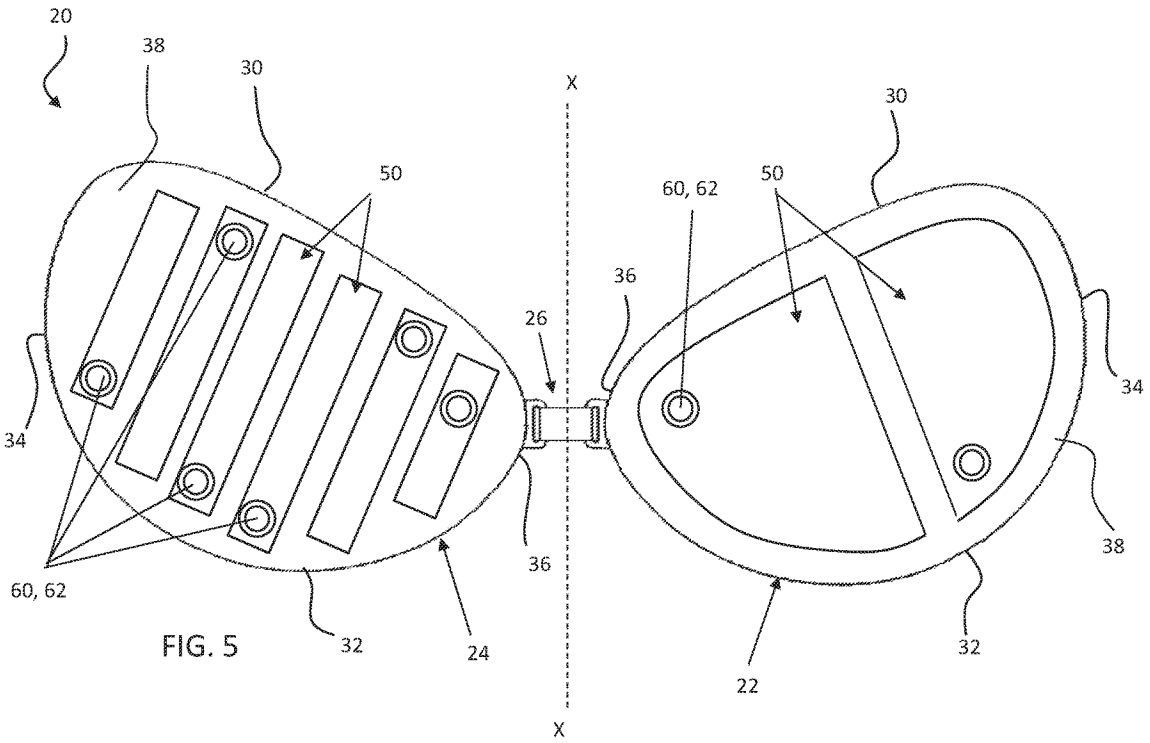
FIG. 5 is a front view of the backless strapless bra having inserts coupled to the interior surface of the first and second cup according to another embodiment.

In the non-limiting embodiment illustrated in FIGS. 4 and 5, a single insert is arranged within the cavity 40 and coupled to the interior surface 38 of each cup 22, 24, respectively. The thickness of the insert 50 may be limited such that when attached to the interior surface 38, at least a portion of cavity 40 remains unfilled. In some embodiments, a portion of the insert 50 may have padding or an increased thickness, such as near a bottom thereof for example, to enhance the look of or provide additional support to a user's breast when the bra 20 and insert 50 are attached thereto.

As shown, the overall shape of the insert 50 may be substantially identical to, or may be generally complementary to the interior surface 38 of the cup 22, 24 to maximize the surface area of the pressure adhesive layer 56 of the insert 50 configured to contact the user's skin. However, in other embodiments, such as illustrated in FIG. 5 for example, a plurality of similar or different inserts 50 may be affixed to an interior surface 38 of a bra cup 22, 24. In addition, the one or more inserts 50 attached to the first cup 22 may have a similar configuration, or alternatively, may have a distinct configuration from the one or more inserts 50 associated with the second cup 24. In one embodiment, the configuration of the one or more inserts 50, specifically the size and position thereof within cavity 40, may be selected to achieve a desired level of support and coverage based on a plurality of factors including the size, shape, and weight of the bra and the user's breasts.

Figure 7:
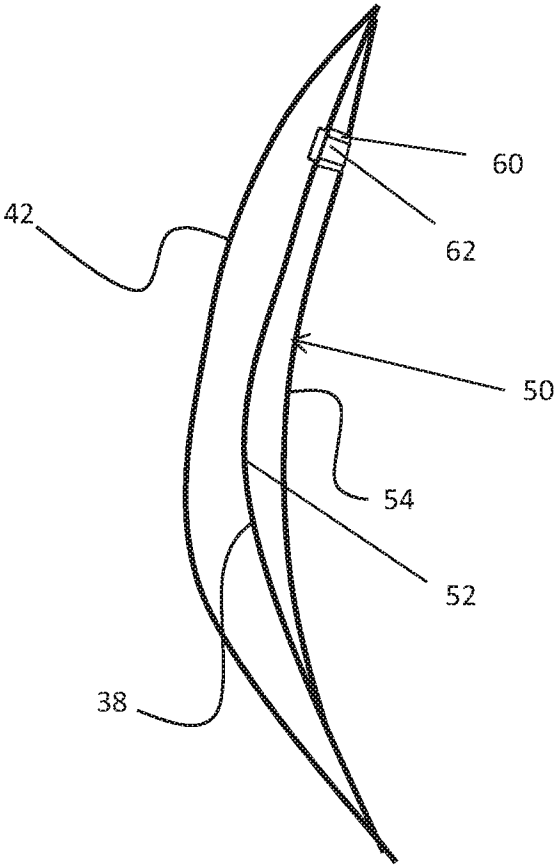
FIG. 7 is a cross-sectional view of a portion of the backless, strapless bra of FIG. 4 taken through a connector according to an embodiment.

Referring also to FIG. 7, as previously suggested, the inserts 50 are configured to removably couple to the respective interior surface 38 of the bra cups 22, 24. In an exemplary embodiment, each insert 50 is configured to mechanically couple/connect to the bra 20. In the illustrated, non-limiting embodiment of FIGS. 4 and 5, each insert 50 includes a male connector 60, such as a socket for example, configured to couple to and mate with a corresponding female connector 62, such as a post for example extending from the interior surface 38 of the cup 22, 24. When connected, the male and female connectors 60, 62 may form a snap fit, press fit, or loose connection, such that the insert 50 is secured to the cup 22, 24. The illustrated coupling formed by connectors 60, 62 is intended as an example only and other types of connectors 60, 62 (or other types of mechanical couplings/connections) may be used to selectively couple the insert 50 to a bra 20. For example, in another embodiment, the first surface 52 of the insert 50 may include one or more pins (not shown), insertable through the interior surface 38 to affix the insert 50 within the cavity 40, or the interior surface 38 of the cup 22, 24 and the first surface 52 of the insert 50 may include corresponding hooks and loops-type attachments (also not shown), although hooks and loops-type attachments are well known, e.g., Velcro®. It should be understood that although each insert 50 is illustrated including a single connector 60 for coupling to the bra 20, embodiments where the inserts 50 are coupled at a plurality of locations are within the scope of the disclosure. In addition, the connector(s) 60 or area(s) where a coupling is formed may be located at any portion of the insert 50, and is not limited to near an edge of the insert 50 as shown in several of the FIGS. It will be appreciated that an adhesive layer is not a mechanical connection or coupling.

With continued reference to FIG. 7, in embodiments where the insert 50 includes the male connector 60 configured to couple to the female connector 62, neither the female connector nor the male connector 60 should extend beyond the second surface 54 of the insert 50 to minimize contact with the user's skin. Further, in some embodiments, a portion of at least one of the male and female connectors 60, 62, such as arranged adjacent the user's skin for example, may be covered with a soft material (not shown), such as fabric or plastic. In addition, the connector 62 mounted to the bra 20 should not be exposed or visible at an exterior surface 42 of the cup 22, 24 to prevent an undesired aesthetic appearance when the bra 20 is worn under an article of clothing.

In a conventional strapless, backless bra, the interior surface 38 of each cup 22, 24 typically includes a pressure sensitive adhesive layer that affixes the cups 22, 24 to the user's skin. However, over time, the adhesion strength of this layer deteriorates such that adhesion strength of the layer is no longer sufficient to adequately adhere the bra 20 to the user's skin. By using a mechanical coupling to attach one or more removable inserts 50 to the interior surface 38 of a bra cup 22, 24, the pressure adhesive layer 56 formed on the inserts 50, rather than on the cups 22, 24 is used to adhere the bra to a user. Once the adhesion strength of the layer 56 formed on the inserts 50 decreases to an unsuitable level, the inserts 50 may be simply replaced with new inserts 50. As a result, the lifespan and usability of a bra 20 including inserts 50 as described herein, such as a backless, strapless bra for example, is extended substantially.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Exemplary embodiments of this invention are described herein, including the best mode known to the inventors for carrying out the invention. Variations of those embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A removable insert for use with a brassiere, comprising:

a body having a first surface and a second surface opposite the first surface;

at least a portion of the second surface configured to provide removable attachment to a user's skin; and a mechanical connection associated with the body and configured to provide removable attachment of the body to the brassiere, wherein when the body is attached to the brassiere, the first surface is disposed adjacent the brassiere to overlap a portion of the brassiere to cover the portion of the brassiere.

2. The removable insert of claim 1, wherein the at least a portion of the second surface configured to provide removable attachment to a user's skin comprises:

a pressure sensitive adhesive layer disposed at the second surface.

3. The removable insert of claim 2, wherein a removable covering is disposed over the pressure sensitive adhesive layer.

4. The removable insert of claim 1, wherein the at least a portion of the second surface configured to provide removable attachment to a user's skin comprises:

at least a portion of the second surface composed of a resilient sticky polymer material.

5. The removable insert of claim 1, wherein the brassiere includes at least one cup and wherein the mechanical connection is configured to provide removable attachment of the body to an interior surface of the at least one cup.

6. The removable insert of claim 5, wherein the body has a shape that is complementary to the at least one cup.

7. The removable insert of claim 1, wherein the mechanical connection comprises at least one of a snap fit connection, press fit connection, and loose fit connection.

8. The removable insert of claim 7, wherein the mechanical connection further comprises at least one of a male connector and a female connector disposed at the body for connection to a cooperating male or female connector disposed at the brassiere, whereby mating of the connectors attaches the body to the brassiere.

9. The removable insert of claim 1, wherein the mechanical connection further comprises at least one of (a) a plurality of hooks and (b) a plurality of loops disposed at the body for connection to cooperating hooks or loops disposed at the brassiere, whereby engagement of the hooks and loops attaches the body to the brassiere.

10. The removable insert of claim 1, wherein the mechanical connection does not extend beyond the second surface.

11. A brassiere, comprising:

a pair of cups, each of the cups having an exterior surface and an interior surface arranged opposite the exterior surface;

a connector coupling the cups together in a side-by-side relationship;

at least one removable insert comprising:

a body having a first surface and a second surface opposite the first surface, and at least a portion of the second surface configured to provide removable attachment to a user's skin; and a mechanical connection associated with at least one of (a) at least one of the cups and (b) the body, the mechanical connection configured to provide removable attachment of the body to the at least one of the cups, wherein when the body is attached to at least one of the cups, the first surface of the body is disposed adjacent the interior surface of the at least one of the cups to overlap a portion of the at least one of the cups to cover the portion of the at least one of the cups.

12. The brassiere of claim 11, wherein the at least one removable insert comprises a pair of removable inserts, further wherein the body of each of the pair of inserts is connected to a corresponding one of the cups.

13. The brassiere of claim 11, wherein the connector coupling the pair of cups selectively couples the cups.

14. The brassiere of claim 11, wherein the connector coupling the pair of cups fixedly couples the cups.

15. The brassiere of claim 11, wherein the brassier is a backless and strapless brassiere.

16. The brassiere of claim 11, wherein the at least a portion of the second surface configured to provide removable attachment to a user's skin comprises:

a pressure sensitive adhesive layer disposed at the second surface.

17. The brassiere of claim 16, wherein a removable covering is disposed over the pressure sensitive adhesive layer.

18. The brassiere of claim 11, wherein the at least a portion of the second surface configured to provide removable attachment to a user's skin comprises:

at least a portion of the second surface composed of a resilient sticky polymer material.

19. The brassiere of claim 11, wherein the mechanical connection is configured to provide removable attachment of the body to the interior surface of the at least one cup.

20. The brassiere of claim 11, wherein the body has a shape that is complementary to at least one of the cups.

21. The brassiere of claim 11, wherein the mechanical connection comprises at least one of a snap fit connection, press fit connection, and loose fit connection.

22. The brassiere of claim 21, wherein the mechanical connection further comprises a male connector and a female connector that mates with the male connector, wherein one of the male connector and the female connector is disposed at the body and the other of the one of the male connector and the female connector is disposed at the at least one of the cups, whereby mating of the male connector and the female connector attaches the body to the at least one of the cups.

23. The brassiere of claim 11, wherein the mechanical connection further comprises a plurality of hooks and a plurality of loops that engage with the plurality of hooks, wherein one of the plurality of hooks and the plurality of loops is disposed at the body and the other of the one of the plurality of hooks and the plurality of loops is disposed at the at least one of the cups, whereby engagement of the plurality of hooks and the plurality of loops attaches the body to the at least one of the cups.

24. The brassiere of claim 11, wherein when the mechanical connection does not extend beyond the second surface.

25. A backless and strapless brassiere receptive to at least one removable insert, comprising:

a pair of cups, each of the cups having an exterior surface and an interior surface arranged opposite the exterior surface;

a connector coupling the cups together in a side-by-side relationship; and a mechanical connection associated with at least one of the cups and configured to provide removable attachment of the at least one of the cups to the at least one removable insert, wherein when the at least one removable insert is attached to the at least one of the cups, the at least one removable insert is disposed adjacent the interior surface of the at least one of the cups to overlap a portion of the at least one of the cups to cover the portion of the at least one of the cups.

26. The backless and strapless brassiere of claim 25, wherein the connector coupling the cups selectively couples the cups.

27. The backless and strapless brassiere of claim 25, wherein the connector coupling the cups fixedly couples the cups.

28. The backless and strapless brassiere of claim 25, wherein the mechanical connection comprises at least one of a snap fit connection, press fit connection, and loose fit connection.

29. The backless and strapless brassiere of claim 28, wherein the mechanical connection further comprises at least one of a male connector and a female connector disposed at the at least one of the cups for connection to a cooperating male or female connector disposed at the at least one removable insert, whereby mating of the connectors attaches the at least one of the cups to the at least one removable insert.

30. The backless and strapless brassiere of claim 25, wherein the mechanical connection further comprises at least one of (a) a plurality of hooks and (b) a plurality of loops disposed at the at least one of the cups for connection to cooperating hooks or loops disposed at the at least one removable insert, whereby engagement of the hooks and loops attaches the at least one of the cups to the at least one removable insert.

* * * * *